US005807667A

United States Patent [19]

Chang

[11] Patent Number: 5,807,667

[45] Date of Patent: Sep. 15, 1998

[54] SENSITIZATION OF SELENIUM AND IRIDIUM EMULSIONS

[75] Inventor: Elizabeth Pui-lu Chang, Webster, N.Y.

[73] Assignee: Eastman Kodak Company, Rochester, N.Y.

[21] Appl. No.: 869,694

[22] Filed: Apr. 16, 1992

[51] Int. Cl.[6] ..... G03C 1/09

[52] U.S. Cl. ..... 430/600; 430/603; 430/605; 430/611; 430/614

[58] Field of Search ..... 430/567, 600, 430/603, 605, 611, 614

[56] References Cited

U.S. PATENT DOCUMENTS

| | | | |
|---|---|---|---|
| 2,131,038 | 9/1938 | Brooker et al. | 430/614 |
| 4,166,742 | 9/1979 | Mifune et al. | 430/568 |
| 4,237,214 | 12/1980 | Mifune et al. | 430/567 |
| 4,578,348 | 3/1986 | Freeman et al. | 430/614 |
| 4,610,954 | 9/1986 | Torigoe et al. | 430/611 |
| 4,665,017 | 5/1987 | Mifune et al. | 430/603 |
| 4,678,745 | 7/1987 | Yamada et al. | 430/567 |
| 4,683,192 | 7/1987 | Nishiyama | 430/603 |
| 4,770,991 | 9/1988 | Kojima et al. | 430/600 |
| 4,801,524 | 1/1989 | Mifune et al. | 430/569 |
| 4,888,273 | 12/1989 | Himmelwright et al. | 430/603 |
| 4,892,807 | 1/1990 | Hirabayashi et al. | 430/567 |
| 4,895,794 | 1/1990 | Ogawa | 430/567 |
| 4,912,026 | 3/1990 | Miyoshi et al. | 430/605 |
| 4,914,016 | 4/1990 | Miyoshi et al. | 430/603 |
| 4,962,016 | 10/1990 | Chino et al. | 430/603 |
| 5,149,619 | 9/1992 | Mihara et al. | 430/600 |
| 5,164,292 | 11/1992 | Johnson et al. | 430/569 |

FOREIGN PATENT DOCUMENTS 0 334 162 9/1989 European Pat. Off. .

OTHER PUBLICATIONS

James, T.H. ed, "The Theory of the Photographic Process", 4th Ed.,Macmillan Publishing Co., 1977, p. 149.

Abstract of JP 59–149345 (Aug. 1984).

Abstract of JP 62–42148 (Feb. 1987).

Abstract of JP 62–178234 (Aug. 1987).

Abstract of JP 1–245242 (Sep. 1989).

Abstract of JP 1–283551 (Nov. 1989.

*Primary Examiner*—Janet C. Baxter

*Attorney, Agent, or Firm*—Paul A. Leipold

[57] ABSTRACT

The invention is generally accomplished by a method of sensitizing comprising providing tabular silver bromoiodide grains or bromoiodide grains doped with Se and Iridium bringing said grains into contact with a benzothiazolium salt or hydrolyzed benzothiazolium salt comprising (A)

or (B)

wherein $R_1$ is hydrogen, alkyl of from 1 to 8 carbon atoms, or aryl of from 6 to 10 carbon atoms, $R_4$ and $R_5$ are independently hydrogen or halogen atoms, aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(0)_2$M groups, wherein M is chosen to complete an aldehyde, ketone, acid, ester, thioester, amide, or salt;

$Y_1$ is a charge balancing counter ion; and

Q is a substituent of the formula:

—LCONHS$0_2$R, —LCONHS$0_2$NHCOR alkyl, sulfoalkyl, phosphoalkyl, hydroxyalkyl, or L—$CONH_2$ wherein L is an alkyl group of from 1 to 8 carbon atoms and R is an alkyl group of from 1 to 8 carbon atoms or a primary amino group, bringing said grains into contact with a mercaptobenzotetrazol comprising (C)

wherein $R_3$ is —$CH_2CONH_2$, —$NHCOR_2$, —$NHCONHR_2$, —$LCONHR_2$, —COOH, —$SO_3$, —OH, —$SO_2NH_2$, —$SO_2NHR_2$, halogen, alkyl, alkoxy, or aryloxyl, $R_2$ is an alkyl with 1–8 carbon or an aryl of 1 to 10 carbons, and heating to complete chemical sensitizing of said grains.

13 Claims, 1 Drawing Sheet

SENSITIZATION OF SELENIUM AND IRIDIUM EMULSIONS

TECHNICAL FIELD

This invention relates to chemical sensitization of silver halide grains. It particularly relates to chemical sensitization of Se and Ir doped grains.

BACKGROUND ART

It is known in the photographic art that chemical sensitization is carried out to improve the sensitivity of silver halide.

The phenyl merocaptotetrazole (PMT) and certain substituted PMT are well-known development inhibitors. Development inhibitors prevent fog formation during development. U.S. Pat. No. 2,403,927 teaches the use of these kinds of compounds in photographic material. Other well-known substituted PMT are disclosed in U.S. Pat. No. 3,295,976 and Japanese 84/052 821. The PMT or substituted PMT may absorb to the silver halide surface so strongly that they interfered chemical sensitization. They are mostly added to the emulsions after the emulsions were chemical and spectral sensitized. U.S. Pat. No. 4,888,273 claims certain substituted PMT added during chemical sensitization followed by azaindene to stabilize T-grain emulsion. The example shows the substituted PMT was really added after chemical ripening. Japanese 1245242-A claims certain substituted PMT can be used as antifoggant for Iridium doped emulsions.

It is known that the class of compound comprised of quaternized thiazolium are effective antifoggants as disclosed by Brooker et al U.S. Pat. No. 2,131,038. Benzothiazolium salts having quaternizing substituents are disclosed by Mifune et al U.S. Pat. No. 4,237,214. In general, a quaternized thiazolium that can be hydrolyzed in the conditions where used is a fog inhibiting agent. U.S. Pat. No. 4,578,348 teaches a class of hydrolyzed quaternized thiazolium as antifoggant.

The thiazolium class of compounds are not as strong emulsion development inhibitors as the PMT class of compounds and can be present in the emulsion before or during chemical and spectral sensitization. But these thiazolium compounds alone are not strong enough to completely control the fog growth during the chemical and spectral sensitization steps for those emulsions that have Se and Ir incorporated in the crystal lattice by doping. The PMT (C) compounds are so strong that the use of a large amount of the compound will result in speed loss. When using sufficient PMT (C) alone to antifog a Se+Ir doped emulsion during chemical and spectral sensitization, the emulsion will not give good photographic speed or contrast.

There is a need for improved chemical sensitization techniques particularly for tabular selenium and Iridium doped emulsions.

DISCLOSURE OF THE INVENTION

An object of the invention is to overcome disadvantages of prior sensitization method and provide improved photographic elements.

These and other objects of the invention are generally accomplished by a method of sensitizing comprising providing tabular silver bromoiodide grains doped with Se and Iridium bringing said grains into contact with a benzothiazolium salt or hydrolyzed benzothiazolium salt comprising

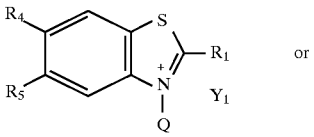

(A)

or

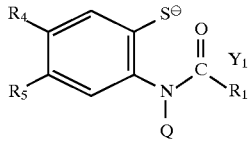

(B)

wherein $R_1$ is hydrogen, alkyl of from 1 to 8 carbon atoms, or aryl of from 6 to 10 carbon atoms, $R_4$ and $R_5$ are independently hydrogen or halogen atoms, aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(O)_2M$ groups, wherein M is chosen to complete an aldehyde, ketone, acid, ester, thioester, amide, or salt;

$Y_1$ is a charge balancing counter ion; and

Q is a substituent of the formula: —$LCONHSO_2R$, —$LCONHSO_2NH_2$, —$LCONHSO_2NHCOR$ alkyl, sulfoalkyl, phosphoalkyl, hydroxyalky, or L—$CONH_2$ wherein L is an alkyl group of from 1 to 8 carbon atoms and R is an alkyl group of from 1 to 8 carbon atoms or a primary amino group, bringing said grains into contact with a mercaptobenzotetrazol comprising

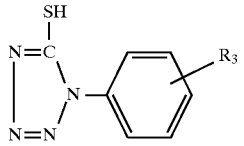

(C)

wherein $R_3$ is —$CH_2CONH_2$, —$NHCOR_2$, —$NHCONHR_2$, —$LCONHR_2$, —COOH, —$SO_3$, —OH, —$SO_2NH_2$, —$SO_2NHR_2$, halogen, alkyl hydrogen, alkoxy, or aryloxyl, $R_2$ is an alkyl with 1–8 carbon or an aryl with 6 to 10 carbon.

Sulfur and gold containing chemical sensitizers generally are added to said emulsion prior to said heating, A or B is added in an amount between about $1\times10^{-8}$ and $1\times10^{-3}$. It is preferred the spectral sensitizers be added prior to sensitization.

The preferred benzothiazolium compounds are 3-methyl-1-3-benzothiazolium (A1) and 3-(N-methylsulfonyl carbamolylethyl benzothiazolium (A2).

The preferred mercaptobenzotetrazol compounds are 1-phenyl-5-mercaptotetrazole (C1) and 1-(3-acetamidophenyl)-5-mercaptotetrazole (C2).

MODES FOR CARRYING OUT THE INVENTION

Figure 1:
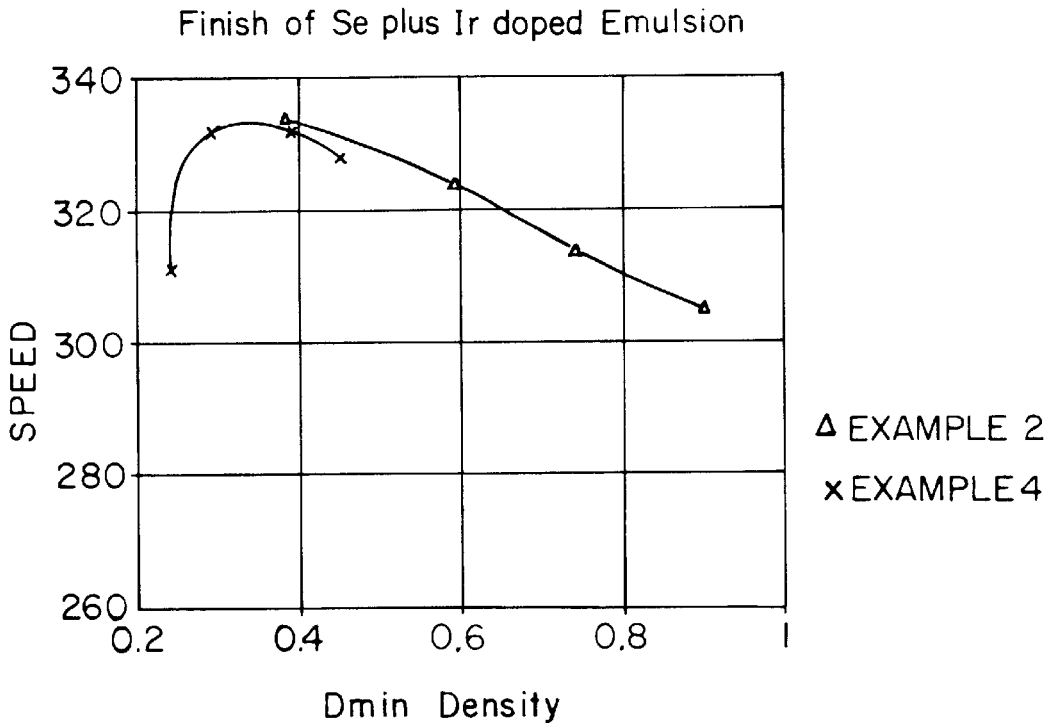
FIG. 1 is a graph of speed/fog for the finish of Examples 2 and 4.

The invention has numerous advantages over prior chemical sensitizations. It allows tabular grains to be sensitized to increase their speed without increasing fog. Further, it allows robust sensitizations that do not fog as a result of small changes in time of sensitization. Further, the chemical sensitizations of the invention are able to be very successfully spectrally sensitized. These and other advantages will be clear from the description below.

The basic spectral and chemical sensitization processes are taught in Image Process and Material (Neblette's Eight Edition, 1989, pp. 92–93) and many other books. The Chemical sensitizer(s) are added to the emulsion followed by heat ripening, followed by adding the spectral sensitizers. This invention generally follows the teachings in U.S. Pat. No. 4,434,226. In U.S. Pat. No. 4,434,226 it teaches that the preferred form of chemical sensitization is to have the spectral sensitizers present prior to chemical sensitization. It is also preferred to have a finish modifier, such as benzothiazolium present during chemical sensitization.

In this invention, because of the Se and Ir doped emulsions are easily fogged, an inhibitor such as PMT is used in combination with the finish modifier, such as benzothiazolium to control fog growth during heat ripening.

The emulsions in the invention have Se and Ir incorporated in the crystal lattice during the making process. This is referred to as a selenium or iridium doped emulsion. They can be conventional or tabular grain, but are preferred to be tabular grain and most preferred to be T-grain with aspect ratio greater than 5. These tabular grain emulsions may have other morphology crystals present as contamination, but these other crystals consist of less than 30 percent of the projected area of the emulsion.

The emulsions can be any silver bromide or silver bromoiodide. The preferred halide composition is bromoiodide, with iodide from 0.01–15 percent and preferably 0.01 to 12% iodide. The Se concentration is in the range of $1\times10^{-4}$ to $1\times10^{-8}$ mole/Ag mole. The preferred selenium range is $1\times10^{-5}$ to $5\times10^{-7}$ mole/Ag mole for best balance of speed and fog. The iridium concentration generally is in the range of $1\times10^{-5}$ to 1×10–9 mole per mole silver. The preferred iridium range is $1\times10^{-6}$ to $1\times10^{-8}$ mole per mole of silver for good exposure reciprocity. In another embodiment of the invention, the bromoiodide emulsion has an iodide content from 0.1 to 12 percent. In another embodiment of the invention, tabular silver bromoiodide or silver bromide grains comprise between $1\times10^{-6}$ and $1\times10^{-8}$ mole/Ag mole iridium and $1\times10^{-5}$ and $1\times10^{-7}$ mole/Ag mole selenium. In another embodiment, the tabular silver bromoiodide or silver bromoiodide grains comprise 0.1 to 15 percent iodide.

The benzothiazolium salts suitable for the invention generally comprise

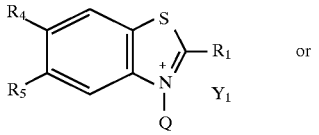

(A)

or

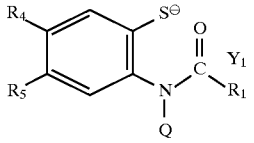

(B)

wherein $R^1$ is hydrogen, alkyl of from 1 to 8 carbon atoms, or aryl of from 6 to 10 carbon atoms, $R^4$ and $R^5$ are independently hydrogen or halogen atoms, aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(O)_2M$ groups, wherein M is chosen to complete an aldehyde, kerone, acid, ester, thioester, amide, or salt;

$Y^1$ is a charge balancing counter ion; and

Q is a quaternizing substituent of the formula: —$LCONHSO_2R$, —$LCONHSO_2NH_2$, —$LCONHSO_2NHCOR$ alkyl, sulfoalkyl, phosphoalkyl, hydroxyalky, or L—$CONH_2$ wherein L is an alkyl group of from 1 to 8 carbon atoms and R is an alkyl group of from 1 to 8 carbon atoms or a primary amino group. In a preferred embodiment, $R_1$, $R_4$, and $R_5$ are hydrogen, and Q=—$CH_3$, —$CH_2CH_2OH$, —$CH_2CH_2CONHSO_2CH_2$).

A preferred composition of Compound A is when Q=$CH_3$ and $Y_1$=$I^-$.

In a preferred composition of Compound A Q=$CH_2CH_2CONHSO_2CH_3$, and Y=$BF_4^-$ and $R_1$, $R_4$, and $R_5$ are hydrogen.

The mercaptobenzotetrazoles suitable for the invention generally comprise

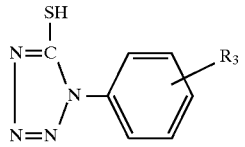

(C)

wherein $R_3$ is —$CH_2CONH_2$, —$NHCOR_2$, —$NHCONHR_2$, —$LCONHR_2$, —COOH, —$SO_3$, —OH, —$S_2NH_2$, —$SO_2NHR_2$, halogen, alkyl, alkoxy, or aryloxyl, $R_2$ is an alkyl with 1–8 carbon or an aryl, and heating to complete spectral and chemical sensitizing of said grains.

The benzothiazolium salts A and B may be added in any suitable amount. It is preferred that they be added in an amount between about $1\times10^{-6}$ and $1\times10^{-3}$ mole per silver mole. It is preferred that the mercaptobenzotetrazoles of Compound C be added in an amount between about $1\times10^{-8}$ and $1\times10^{-3}$. It is most preferred that the concentration of A or B compound be between $1\times10^{-5}$ and $1\times10^{-3}$ mole per mole silver with the concentration of Compound C at between $5\times10^{-6}$ and $1\times10^{-4}$ mole per mole silver.

Emulsions of the invention generally comprise tabular grain emulsions, preferably bromoiodide with an iodide content of between 0.1 and 12 percent. The silver iodide grains of the invention generally have an aspect ratio of greater than 2 and preferably an aspect ratio of greater than 5 in order to provide improved speed. The tabular grains form greater than 70 percent of the projected area of the emulsions, and most preferably greater than 90 percent of the projected area of the emulsions for best speed/grain performance.

The sulfur and gold containing chemical sensitizers generally are added to the emulsion prior to the heating during chemical sensitization. The alkaline salt of thiocyanine can also be added with other sulfur and gold chemical sensitizers. Reduction chemical sensitizers also can be utilized. The reduction sensitizers include urea, stanous chloride, and hydrogen.

In this invention, the general chemical sensitizing procedure is as described in U.S. Pat. No. 4,434,226. The emulsions of the invention are formed with Se and Ir incorporated into the crystal by doping during grain formation. The chemical sensitizer(s) can be a sulfur or gold or the combination of both.

Sulfur sensitizers suitable for the invention are compounds containing sulfur capable of reacting with silver ions. The well-known sulfur sensitizers include thiosulfates, thioureas, thiazos, rhodanine active gelatin, and crystine.

Gold sensitizers suitable for use with the invention are a variety of gold compounds including those having either +1 valent or +3 valent oxidation number. Typical of such sensitizers include chloroauric acid, potassium chloroaurate, auric tirchloride, potassium auric thiocyanate, potassium iodoaurate, and tetracyanoauric.

The spectral sensitizers can be any spectral sensitizing dye or combination of spectral sensitizing dyes to give a desirable optical wavelength. The spectral sensitizer may contain a dye not having any spectral sensitizing function in itself or a substance substantially not capable of absorbing visible rays of light, but capable of providing a supersensitization, as in U.S. Pat. No. 2,688,545. Other examples of sensitizing dyes and supersensitizers are described in U.S. Pat. No. 4,434,226.

In this invention, the spectral sensitizer can be added before or after the thiocyanate pentahydrate. There also can be a silver concentration adjustment before or after the dye addition as was taught in the U.S. Pat. No. 4,434,226.

The following examples illustrate the practice of this invention. They are not intended to be exhaustive of all possible variations of the invention. Parts and percentages are by weight unless otherwise indicated.

EXAMPLE 1

Making of the Selenium and Iridium Doped Emulsion

An approximately 1.2 $\mu$m silver bromoiodide (overall iodide content 6 mole percent) tabular grain emulsion with Selenium and Iridium incorporated in the crystal lattice was prepared by a double-jet precipitation technique utilizing accelerated flow.

In a 4-liter aqueous bone gelatin solution (Solution A, 0.3% gelatin by weight and 0.068 molar NaBr), add in 40 ml of silver nitrite solution (Solution B, 2.75 molar) in 1½ minutes, at 70 degrees, and at a constant flow rate. At 1½ minutes, a 4-liter aqueous bone gelatin solution (Solution C, 4.2% gelatin by weight) was added and stirred for 10 minutes. This segment consumed 1% of the total silver. Solution D, (2.63 molar NaBr and 0.116 molar KI) and Solution B were added to the reaction vessel by double-jet addition utilizing accelerated flow (4× from start to finish) over 40 minutes at pBr 1.78. At 3 minutes before the end of this segment, 0.25 mg of potassium hexachloriridate(IV) in 0.1N nitric acid was added into the reaction vessel. This segment consumed 70% of the total silver.

To complete the precipitation, 525 ml of Solution E (Solution E, 5.94 molar NaBr, 0.15 molar KI) and 536 ml of Solution F (Solution F, 0.44 molar AgI) premixed with 0.081 mmole of potassium selenocyanate was added to the reaction vessel. Solution A was added in constant flow to bring the pBr to 2.40. 11 moles of silver were used to prepare this emulsion.

The emulsion was cooled down to 40 degrees and washed by ultrafiltration to pBr 3.55. One-half liter of aqueous bone gelatin (50% by weight) was added into the emulsion.

The tabular grains have an average aspect ratio of 10:1 and account for greater than 85% of the total projected area of the emulsion grain surface.

EXAMPLE 2

(Control) Uuse of3-methyl-1,3-benzothiazolium (Compound A1) as Finish Modifier

In the above emulsion at 40 degrees, 150 mg/Ag mole of sodium thiocyanate, and green spectral sensitizers 522 mg/Ag mole of anhydro-5-chloro-9-ethyl-5'-phenyl-3'-(3-sulfobutyl)-3-(3-sulfopropyl) oxacarbocyanine hydroxide tetraethyl amine salt, and 167 mg/Ag mole of anhdro-9-ethyl-3,3'-bis(3-sulfopropyl)-4,5,4',5'-dibenzooxacarbocyanine sodium salt were added, then 2 mg/Ag mole of sodium thiosulfate pentahydrate, 4.78 mg/Ag mole of sodium aurous thiosulfate dihydrate, 50 mg/Ag mole of 3-methyl-1,3-benzothiazolium iodide were added. The emulsion was heated to 60 degrees in 15 minutes and was then held at 60 degrees. Samples were taken at 5, 10, 15, and 20 minutes to determine the time required to obtain maximum speed.

EXAMPLE 3

(Control) Use of 3-(N-methylsulfonyl) carbamolylethyl benzothiazolium as (Compound A2) as finish modifier The Se and Ir doped emulsion was spectral and chemical sensitized as in Example 2, except the 1.65 mg/Ag mole of sulfur and 3.34 of the gold sensitizers were used, and 30 mg/Ag mole of Compound A2 replaced Compound A1.

EXAMPLE 4

(Invention) Use of Compound A1 plus 1-phenyl-5-mercapto tetrazole (C1) as finish modifier The Se and Ir doped emulsion was spectral and chemical sensitized as in Example 2, except in addition to the Compound B1, 17 mg/Ag mole of PMT was added to the emulsion before heat rise.

EXAMPLE 5

(Invention) Use of Compound A2 plus C1 as finish modifier

The Se and Ir doped emulsion was spectral and chemical sensitized as in Example 3, except in addition to the Compound A2, 8.5 mg/Ag mole of C1 was added to the emulsion before heat rise.

EXAMPLE 6

(Invention) Use of Compound A2 plus 1-(3-actamidophenyl)-5-mercaptotetrazole (C2) (APMT) as finish modifier The Se and Ir doped emulsion was spectral and chemical sensitized as in Example 3, except in addition to the Compound B2, 11.25 mg/Ag mole of C2 was added before heat rise.

All of the samples taken were coated in the magenta single layer format on cellulose triaceta support at Ag 75 mg/sq. ft. and gelatin 150 mg/sq. ft. Also contain magenta coupler 484 mg/sq. ft.

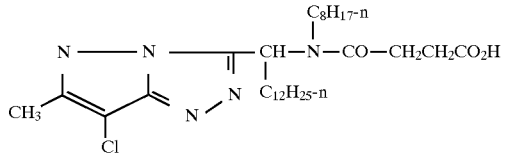

32.6 mg/m$^2$, 215-O, 1.5 g/Ag mole of 4-hydroxy-6-methyl-1,3,3a,7-tetraazaindene. The coatings contained a 2152 mg/m$^2$ gelatin overcoat and were hardened with 1.5% by weight of bis(vinyl-sulfonyl methyl) based on total gelatin. Exposure was for 1/25 sec. through a 0–4 step tablet, plus Wratten 9 filter, to a 5500K day light source. Processing was conducted at 37.7 C in color developer of the type described in the *British Journal of Photoaraphy Annual,* 1979, pp. 204–206, with development time of 3 ¼ minutes. Speed is defined as 100(1-log E), Log E being measured at 0.15 density above $D_{min}$.

Figure 2:
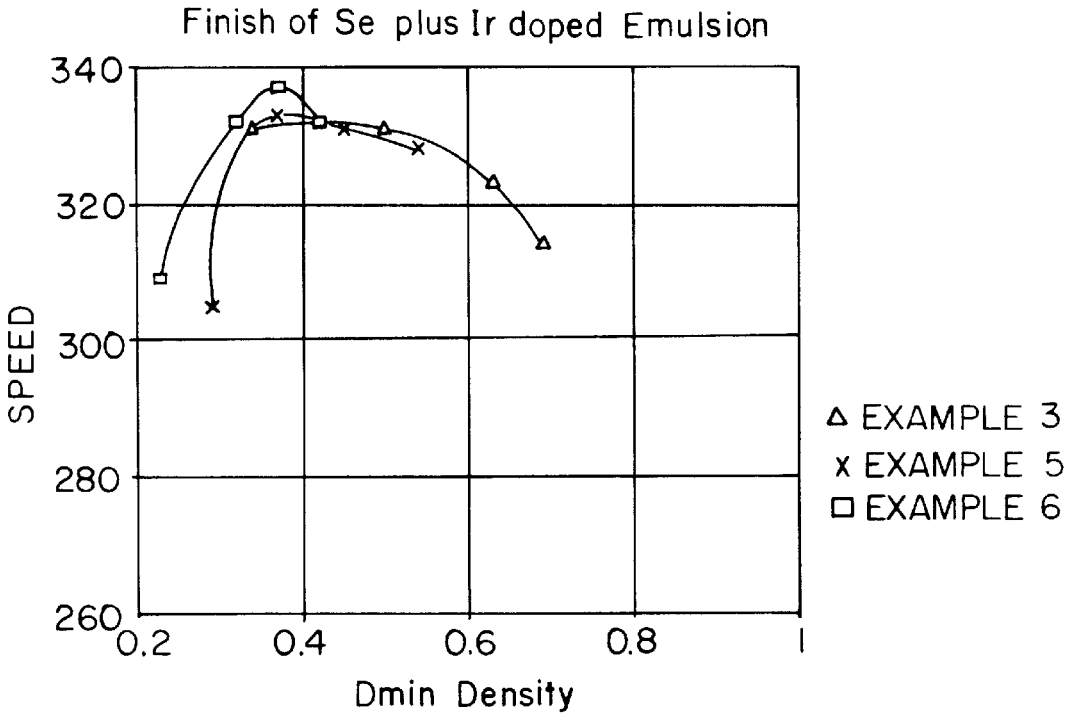
FIG. 2 is a graph of the speed/fog for the finish of Examples 3, 5, and 6.

Results of these spectral chemical sensitizations were plotted in FIG. 1 and FIG. 2. In FIG. 1 is plotted speed and fog growth during the chemical sensitization, heat ripening step, with 5, 10, 15, and 20-minute holds at 60 degrees. The emulsion is Se+Ir doped. Example 2 is with benzothiazolium (A1). Example 4 is with (A1) and (C1) a PMT plaso compound. In FIG. 2 is plotted speed and fog growth during chemical sensitization, heat ripening step, with 5, 10, 15, and 20-minute holds at 60 degrees. The emulsion is Se+Ir doped. Example 3 is with benzothiazolium (A2). Example 5 is with (A2) and (C1). Example 6 is with (A2) and (C2). Each connected curve represents one example. The first 5-minute hold after heat rise was the point with the lowest $D_{min}$ density, and the subsequence points represented the 10, 15, 20-minute hold after heat rise. These curves showed the $D_{min}$ growth after the emulsion reached its maximum speed for the finishes with PMT class compounds or with APMT. The curves also showed the finishes with PMT class compounds or with APMT had the potential of giving higher speed and lower $D_{min}$ than the finishes without the C1, or C2. The FIGS. 1 and 2 also show that the finishes are robust with only small changes in performance causes by change of sensitization time.

The invention has been described in detail with particular reference to preferred embodiments thereof, but it will be understood that variations and modifications can be effected within the spirit and scope of the invention.

I claim:

1. A method of sensitizing comprising providing tabular silver bromoiodide grains or silver bromide grains doped with Se and Iridium, bringing said grains into contact with a benzothiazolium salt comprising a 3-methyl-1-3-benzothiazolium salt or a 3-(N-methylsulfonyl) carbamolyethyl benzothiazolium salt, bringing said grains into contact with a mercaptobenzotetrazole in an amount between about $5\times10^{-6}$ and $1\times10^{-4}$ mole/Ag mole, said mercaptobenzotetrazole comprising (C)

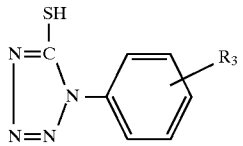

wherein $R_3$ is —$CH_2CONH_2$, —$NHCOR_2$, —$NHCONHR_2$ $LCONHR_2$, —COOH, —$SO_3$, —OH, —$SO_2NH_2$, —$SO_2NHR_2$, halogen, alkyl, hydrogen, alkoxy, or aryloxyl, L is an alkyl group of from 1 to 8 carbon atoms, $R_2$ is an alkyl with 1–8 carbon or an aryl of 6–10 carbon atoms, and heating to complete chemical sensitizing of said grains with the proviso that said benzothiazole and said mercaptobenzotetrazole compound C are added prior to said heating to complete chemical sensitizing.

2. The method of claim 1 wherein sulfur and gold containing chemical sensitizers are added to said emulsion prior to said heating.

3. The method of claim 2 wherein spectral sensitizers are also added prior to heating.

4. The method of claim 1 wherein said benzothiazolium salt is added in an amount between $1\times10^{-6}$ and $1\times10^{-3}$ mole/Ag mole.

5. The method as in claim 1 wherein the emulsion is a bromoiodide emulsion with I content from 0.1 to 12%.

6. The method of claim 1 wherein said silver bromoiodide grains have an average aspect ratio of greater than 2.

7. The method of claim 6 wherein said grains have an aspect ratio of greater than 5.

8. The method of claim 1 wherein said selenium is present in an amount between about $1\times10^{4}$ and $1\times10^{-8}$ mole/Ag mole and said Iridium is present in an amount between about $1\times10^{-5}$ and $1\times10^{-9}$ mole/Ag mole.

9. The method of claim 8 wherein said Iridium is present in an amount between $1\times10^{-6}$ and $1\times10^{-8}$ mole/Ag mole and said selenium is present in an amount between $1\times10^{-5}$ and $1\times10^{-7}$ mole/Ag mole.

10. The method of claim 1 wherein said grains comprise 0.1 to 15 percent iodide.

11. The method of claim 1 wherein said mercaptobenzotetrazole comprises 1-(3-acetamido-phenyl)-5-mercaptotetrazole.

12. The method of claim 1 wherein said mercaptobenzotetrazole comprises 1-phenyl-5-mercaptotetrazole.

13. The method of claim 1 wherein said benzothiazolium salt comprises a 3-methyl-1-3-benzothiazolium salt or a 3-(N-methylsulfonyl) carbamoylethyl benzothiazolium salt.

* * * * *